US009091133B2

(12) United States Patent
Stewart et al.

(10) Patent No.: US 9,091,133 B2
(45) Date of Patent: Jul. 28, 2015

(54) SWELLABLE MATERIAL ACTIVATION AND MONITORING IN A SUBTERRANEAN WELL

(75) Inventors: Benjamin B. Stewart, Aberdeen (GB); Rutger Evers, Stavanger (NO); Roger L. Schultz, Ninnekah, OK (US); Tom Rune Koloy, Sandnes (NO); John C. Gano, Corrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1579 days.

(21) Appl. No.: 12/389,715

(22) Filed: Feb. 20, 2009

(65) Prior Publication Data

US 2010/0212891 A1 Aug. 26, 2010

(51) Int. Cl.

| | |
|---|---|
| ***E21B 23/00*** | (2006.01) |
| ***E21B 33/12*** | (2006.01) |
| ***E21B 47/00*** | (2012.01) |
| ***E21B 47/09*** | (2012.01) |

(52) U.S. Cl.

CPC ..... *E21B 23/00* (2013.01); *E21B 33/1208* (2013.01); *E21B 47/00* (2013.01); *E21B 47/09* (2013.01)

(58) Field of Classification Search

CPC ..... E21B 33/1208
USPC ..... 166/250.09
See application file for complete search history.

(56) References Cited

U.S. PATENT DOCUMENTS

| | | | | |
|---|---|---|---|---|
| 4,510,387 | A * | 4/1985 | Izumi et al. | 850/9 |
| 4,768,590 | A | 9/1988 | Sanford et al. | |
| 4,962,815 | A | 10/1990 | Schultz et al. | |
| 5,981,961 | A * | 11/1999 | Edwards et al. | 250/492.21 |
| RE37,065 | E * | 2/2001 | Grahn | 73/628 |
| 6,601,671 | B1 * | 8/2003 | Zhao et al. | 181/108 |
| 6,865,934 | B2 | 3/2005 | Schultz | |
| 6,924,745 | B2 | 8/2005 | Schultz | |
| 7,040,402 | B2 | 5/2006 | Vercaemer | |
| 7,234,517 | B2 | 6/2007 | Streich et al. | |
| 7,431,098 | B2 * | 10/2008 | Ohmer et al. | 166/387 |

(Continued)

FOREIGN PATENT DOCUMENTS

| | | |
|---|---|---|
| EP | 0232576 A1 | 8/1987 |
| EP | 0816631 A2 | 1/1998 |

(Continued)

OTHER PUBLICATIONS

Ion Implantation article, Wikipedia, (http://en.wikipedia.org/wiki/Ion_implantation), Nov. 9, 2008, 5 pages.

(Continued)

*Primary Examiner* — Shane Bomar
*Assistant Examiner* — Kipp Wallace
(74) *Attorney, Agent, or Firm* — Smith IP Services, P.C.

(57) ABSTRACT

Systems and methods are provided for swellable material activation and monitoring in a subterranean well. A sensor system for use in a subterranean well includes a swellable material, and at least one sensor which is displaced to a wellbore surface in response to swelling of the swellable material. Another sensor system includes a sensor which detects swelling of a swellable material. A swellable well tool system includes a base pipe, a swellable material on an exterior of the base pipe, and eccentric weighting for inducing rotation of the swellable material about a longitudinal axis of the base pipe.

13 Claims, 8 Drawing Sheets

(56) References Cited

U.S. PATENT DOCUMENTS

| | | | | |
|---|---|---|---|---|
| 2004/0173363 | A1* | 9/2004 | Navarro-Sorroche | 166/387 |
| 2005/0199401 | A1 | 9/2005 | Patel et al. | |
| 2007/0151724 | A1 | 7/2007 | Ohmer et al. | |
| 2007/0256485 | A1* | 11/2007 | Rensel et al. | 73/146 |
| 2008/0121390 | A1* | 5/2008 | O'Malley et al. | 166/207 |
| 2008/0125335 | A1 | 5/2008 | Bhavsar | |
| 2008/0149351 | A1* | 6/2008 | Marya et al. | 166/387 |
| 2008/0236271 | A1 | 10/2008 | Zhang | |

FOREIGN PATENT DOCUMENTS

| | | | |
|---|---|---|---|
| EP | 1455052 | A2 | 9/2004 |
| GB | 2387863 | A | 10/2003 |
| GB | 2398640 | A | 8/2004 |
| WO | 9850681 | A1 | 11/1998 |
| WO | 0165067 | A1 | 9/2001 |
| WO | 2008049835 | A1 | 5/2008 |
| WO | 2008149835 | A1 | 12/2008 |

OTHER PUBLICATIONS

Application Halliburton Sand Control Screen, 84 pages.
Halliburton Easywell Constrictor® Annular Barrier Tool Product Brochure H04991, Oct. 2008, 2 pages.
Halliburton Easywell Constrictor® HT Annular Barrier Tool Product Brochure H06450, Oct. 2008, 2 pages.
Halliburton Easywell Constrictor® OMB Annular Barrier Tool Product Brochure H06451, Oct. 2008, 2 pages.
HPI Extreme Plug for Extreme Expansion, http://www.hpi.no/Plugs/Extreme%20plug.htm, Mar. 26, 2009, 1 page.
TAM International, TAM-J Multiple Set Inflatable Packer System product brochure, undated, 8 pages.
TAM International, TAM SlikPak™ Plus product brochure, undated, 4 pages.
Halliburton Easywell Swellpacker® Isolation System H04810, Aug. 2008, 2 pages.
Halliburton Sperry Drilling Services, Geo-Span® Downlink Service H06444-A4, Aug. 2008, 2 pages.
Halliburton WellDynamics Direct Hydraulics Downhole Control System product brochure, Sep. 30, 2008, 2 pages.
Halliburton Easywell Constrictor® Annular Barrier Tool H04991, Oct. 2008, 2 pages.
International Search Report with Written Opinion issued Oct. 8, 2010, for International Patent Application No. PCT/US2010/024375, 11 pages.
International Preliminary Report on Patentability issued Sep. 1, 2011 for PCT Patent Application No. PCT/US10/024375, 7 pages.
Office Action issued Jul. 25, 2013 for Canadian Patent Application No. 2,751,473, 2 pages.
Mexican Office Action issued Sep. 8, 2014 for Mexican patent application serial No. MX/a/2011/008597, 3 pages.
English Translation of relevant portion of Office Action issued Sep. 8, 2014 for Mexican patent application serial No. MX/a/2011/008597, 1 page.

* cited by examiner

SWELLABLE MATERIAL ACTIVATION AND MONITORING IN A SUBTERRANEAN WELL

BACKGROUND

The present disclosure relates generally to equipment utilized and operations performed in conjunction with a subterranean well and, in an embodiment described herein, more particularly provides for swellable material activation and monitoring in a subterranean well.

While it has been known for many years that swellable materials are useful in subterranean wells, "intelligent" swellables have not progressed much beyond equipping swellable packers with certain sensors to detect, for example, pressure in and about the swellable material. However, the ability of a swellable material to conform to the shape of the wellbore surface which it contacts opens up a variety of possibilities for mapping the wellbore surface to, for example, determine the wellbore geometry, detect changes in stresses about the wellbore, evaluate packer differential pressure sealing capability, etc.

Furthermore, improvements are needed in detection of packer setting, evaluation of material swelling, utilization of swellable materials in well operations, etc. For these reasons and others, the present disclosure provides advancements in the art of swellable material activation and monitoring in a subterranean well, which advancements may be utilized in a variety of different applications.

SUMMARY

In the present specification, systems and methods are provided which solve at least one problem in the art. One example is described below in which setting of a seal element is sensed and a well tool is actuated in response. Another example is described below in which wellbore surface and seal element shapes can be detected using sensors and detectable substances in the seal element.

In one aspect, a sensor system for use in a subterranean well is provided. The system includes a swellable material and at least one sensor which is displaced to a wellbore surface in response to swelling of the swellable material.

In another aspect, a sensor system is provided which includes a swellable material and at least one sensor which detects swelling of the swellable material.

In yet another aspect, a swellable well tool system is provided which includes a base pipe; a swellable material on an exterior of the base pipe; and eccentric weighting for inducing rotation of the swellable material about a Longitudinal axis of the base pipe.

These and other features, advantages and benefits will become apparent to one of ordinary skill in the art upon careful consideration of the detailed description of representative embodiments below and the accompanying drawings, in which similar elements are indicated in the various figures using the same reference numbers.

DETAILED DESCRIPTION

Figure 1:
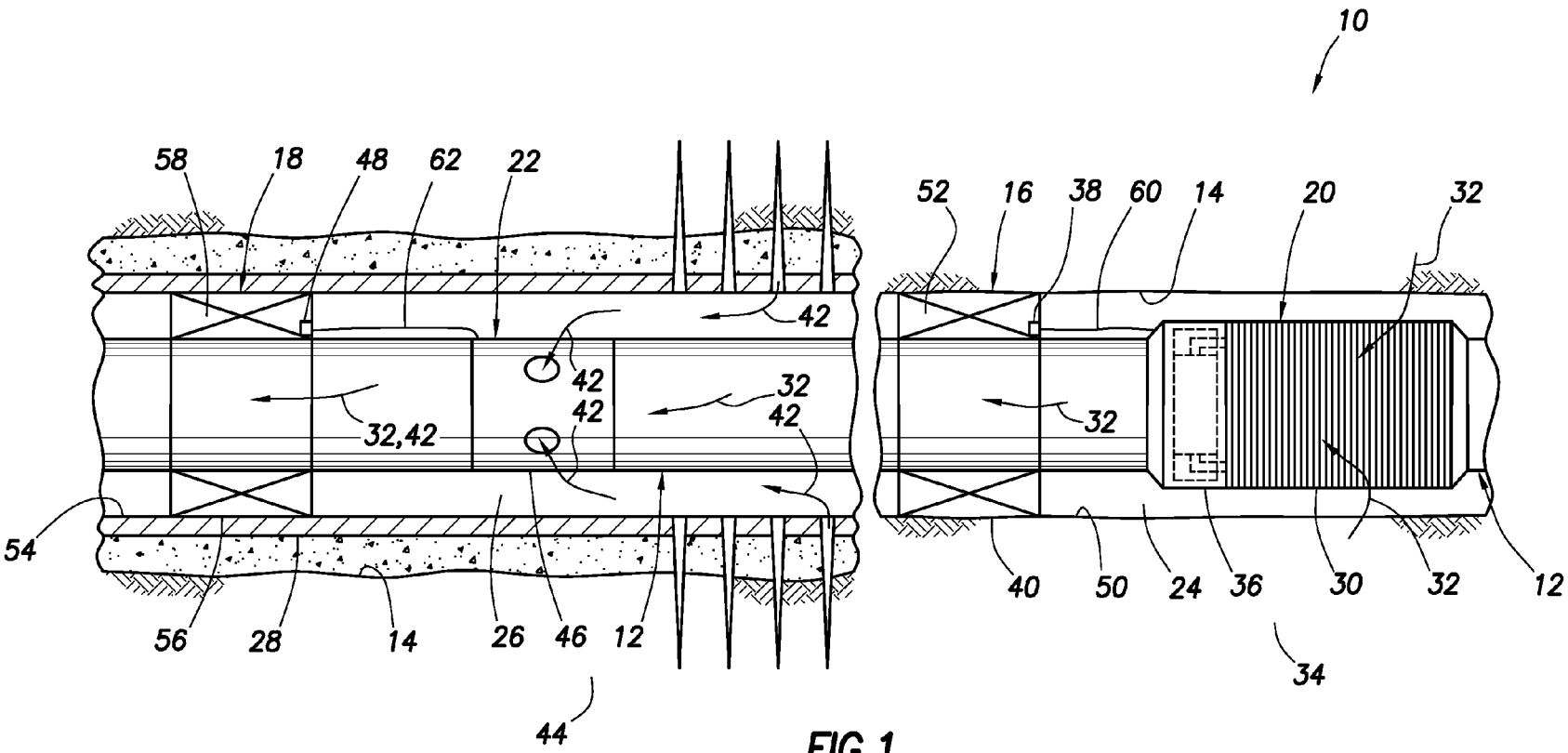
FIG. 1 is a schematic partially cross-sectional view of a sensor system embodying principles of the present disclosure.

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments. In the following description of the representative embodiments of the disclosure, directional terms, such as "above", "below", "upper", "lower", etc., are used for convenience in referring to the accompanying drawings.

In various examples described below, the principles of this disclosure are incorporated into a packer assembly used to seal off an annulus in a well, and are incorporated into a well tool used to position certain components in a wellbore. However, it should be clearly understood that the disclosure principles are not limited to use with packer assemblies or any other particular well tools, use in sealing off an annulus, or any other particular use. Instead, the disclosure principles are applicable to a wide variety of different well tools and methods.

In one example, a tracer material is released upon setting of a packer. For example, a rupture disc may burst to release the tracer material in response to a pressure increase in a swellable material due to the packer setting. For example, the rupture disk is located at or near the surface of the swellable material that is to come into contact with the wellbore. When the swellable material contacts the wellbore, the rupture disc opens due to the contact force, releasing the tracer material. A sensor of the packer detects the tracer material as an indication of the packer being set. Another well tool (such as a flow control device) is operated in response to the sensor detecting the tracer material. The sensor is preferably positioned in an end ring of the packer.

In another example, a detectable substance is incorporated into a packer seal element. The substance displaces as a swellable material of the seal element swells. For example, the detectable substance is encapsulated in cavities within the swellable material, which expand and burst when the swellable material swells. One or more sensors positioned in an interior of the packer, or near the packer, detect the displacement of the substance as an indication of the extent to which the swellable material has swollen.

In yet another example, pressure sensors are incorporated into a swellable packer seal element. The sensors detect a pressure increase in the seal element as an indication of sealing (e.g., due to the seal element pressing against a wellbore surface). Sensors are positioned at an interface between the seal element and a base pipe of the packer. Other pressure sensors are embedded in the seal element, and still other pressure sensors are positioned at a seal surface of the seal element. Various modes of telemetry are used to transmit indications from the sensors to a remote location (such as the earth's surface or another location in the well).

In a further example, the extent to which a packer seal element has expanded can be measured. For example, ion implants could be provided in the seal element to enable mapping of the wellbore surface which the seal element contacts. The mapping is via a sensor (e.g., conveyed by wireline or coiled tubing through a base pipe of the packer) which detects the ion implants or other substance in the seal element. This allows modeling of a surface of an uncased wellbore, or the interior of a casing. Polymer switches can be used to activate sensors in the seal element, and electrical generators can be used to provide power to the sensors.

In a still further example, a swellable material is used to displace a sensor into contact with a wellbore surface at an interval intersected by the wellbore. Another sensor can be used to detect a property of fluid flowing between the interval and an interior of the base pipe, to thereby determine certain parameters (based on differences between the indications received from the different sensors). For example, the parameters may be flow rate, composition, thermal properties, physical properties of the fluid, etc. When accomplished at multiple locations along a production or injection string, this process allows the contribution to flow to or from each interval to be determined.

The sensors could include temperature, pressure and/or other types of sensors. For example, the sensor on the packer could comprise an optical waveguide (such as an optical fiber) wrapped about the seal element. The sensors may be in communication with another well tool, and the well tool can be actuated in response to the indications output by the sensors.

The swellable material can displace the sensor into a certain portion of the wellbore (such as an upper side of a deviated or horizontal wellbore). The swellable material can be eccentrically weighted to thereby azimuthally orient components (such as a shunt tube, a sensor, a perforating gun, etc.) relative to the wellbore. In this manner, the components can be laterally and/or circumferentially displaced relative to the wellbore in a predetermined direction by the swellable material.

Note that the features of the various examples discussed briefly above are not mutually exclusive. Instead, any of the features of any of the examples described below can be incorporated into any of the other examples.

Representatively illustrated in FIG. 1 is a sensor system 10 which embodies principles of the present disclosure. In the system 10, a tubular string 12 is positioned in a wellbore 14. The tubular string 12 includes packer assemblies 16, 18 and additional well tools 20, 22.

As depicted in FIG. 1, the packer assembly 16 is set in an open hole (uncased) portion of the wellbore 14 to thereby seal off an annulus 24 formed radially between the tubular string 12 and the wellbore, and the packer assembly 18 is set in a cased portion of the wellbore to thereby seal off an annulus 26 formed radially between the tubular string and casing 28 lining the wellbore. However, any or both of the packer assemblies 16, 18 may be located in and set in either of the uncased or cased portions of the wellbore 14.

The wellbore 14 is illustrated in FIG. 1 as being generally horizontally oriented, but the wellbore could instead be generally vertically oriented or inclined (deviated) relative to the vertical direction. The tubular string 12 is representatively a production tubing string or completion string, but other types of tubular strings (e.g., casing or liner strings, injections strings, etc.) may also incorporate the principles of this disclosure.

The well tool 20 as depicted in FIG. 1 includes a well screen 30 which filters fluid 32 flowing into the tubular string 12 from an interval 34 intersected by the wellbore 14. The well tool 20 also includes a flow control device 36 associated with the well screen 30. The flow control device 36 may be any type of flow control device, such as a valve, a check valve or an inflow control device of the type which restricts flow of the fluid 32 into the tubular string 12.

In one unique feature of the system 10, the packer assembly 16 has sensors integrated into the packer element which use displacement and deformation of a swellable material to visualize the wellbore 14 and measure swell pressure or contact pressure between the wellbore 14 and packer assembly 16. The ability to measure a change in distance of the swellable material from a base pipe of the packer assembly 16, or variations in contact pressure is utilized to define the geometry of the wellbore 14. Over the life of the well, this facilitates measurement of changes in stress around the wellbore 14. The performance of the packer assembly 16 can be monitored and modeled in dynamic environments, such as during fracturing and other stimulation treatments, perforating, etc.

The packer assembly 16 can include at least one sensor 38 which can perform a variety of functions to enhance the performance and operability of the system. Some of these functions (detecting setting of the packer assembly 16, detecting a shape of a seal element 40, detecting pressures and/or temperatures, etc.) have been briefly discussed above, and will be described more fully below in relation to specific examples of configurations of the packer assembly 16.

The sensor 38 can be a vibration sensor (such as an accelerometer, etc.). Vibration can be used to identify laminar or turbulent flow which can, in turn, be used to indicate type of fluid, annulus flow past a packer, flow in the rock structure surrounding the packer assembly 16 and thus bypassing the packer assembly, etc. This information can be used in various other ways, such as flowing additional swelling material, indicating water or gas flow, indicating formation issues, etc.

As depicted in FIG. 1, the sensor 38 is connected to the well tool 20, and the sensor is used to control operation of the flow control device 36. For example, the flow control device could be opened or less restrictive to flow of the fluid 32 in response to detection of the packer assembly 16 being set, or the flow control device could be closed or more restrictive to flow of the fluid in response to detection of a volume change in the seal element 40 due to water or gas encroachment, etc. These are but a few examples of the wide variety of possible uses for the principles described in this disclosure.

The other packer assembly 18 is set in the cased portion of the wellbore 14 as described above, in order to seal off the annulus 26. Fluid 42 flows from an interval 44 intersected by the wellbore 14 into the tubular string 12 via the well tool 22. The fluids 32, 42 commingle in the tubular string 12 and flow to a remote location, such as the earth's surface or a seafloor pipeline, etc.

The well tool 22 is depicted in FIG. 1 as comprising a flow control device 46 (such as a valve, choke, etc.), but other types of well tools (such as packers, chemical injectors, sensors, actuators, etc.) may be used it desired. The well tool 22 could be used in place of the well tool 20, and vice versa.

In another unique feature of the system 10, the packer assembly 18 includes at least one sensor 48 which can perform any of the functions described herein, and which may be similar to the sensor 38 described above. The sensor 48 is illustrated in FIG. 1 as being connected to the well tool 22, in order to control operation of the well tool in a manner similar to control of the well tool 20 using the sensor 38 as discussed above. Alternatively, or in addition, the sensors 38, 48 can be used to determine the contribution of each of the fluids 32, 42 to the commingled flow through the tubular string 12, as described more fully below.

Note that the packer assembly 16 seals against an uncased surface 50 of the wellbore 14, which may be irregular (e.g., due to washouts, restrictions, cave-ins, etc.). For this reason, seal element 40 of the packer assembly 16 preferably includes a swellable material 52 which enables the seal element to conform closely to the shape of the wellbore surface 50. In another unique feature of the system 10, the sensor 38 may be used to detect swelling of the swellable material 52, the shape and/or volume of the swellable material, the shape of the wellbore surface 50, changes in these shapes and volume, etc.

In contrast, the packer assembly 18 seals against a wellbore surface 54 which may be relatively smooth and consistent in shape. Nevertheless, a seal element 56 of the packer assembly 18 could also include a swellable material 58, if desired, for convenience, economics and/or operability reasons.

The sensors 38, 48 are depicted in FIG. 1 as being connected to the well tools 20, 22 via lines 60, 62 (e.g., electrical or optical lines, etc.). However, the sensors 38, 48 could communicate with the well tools 20, 22 via any type of wireless telemetry (e.g., acoustic, pressure pulse, electromagnetic, etc.), and the sensors could communicate with a remote location (e.g., a data collection and/or control system at the surface or seafloor, another location in the well, etc.), as well.

The sensors 38, 48 are depicted in FIG. 1 as being incorporated physically into the packer assemblies 16, 18 within the seal elements 40, 56. However, the sensors 38, 48 could instead be incorporated into other portions of the packer assemblies 16, 18 (such as, in end rings straddling the seal elements 40, 56, flush mounted on the external surface of the seal elements, etc.), could be received within the interiors of the packer assemblies (such as, in a flow passage extending through the packer assemblies, etc.), and could be conveyed into the wellbore 14 separately from the packer assemblies (such as, by wireline, slickline or coiled tubing, etc.).

Thus, it will be appreciated that a wide variety of different configurations are possible for the packer assemblies 16, 18, well tools 20, 22 and sensors 38, 48. Several of these different configurations are described more fully below, but it should be clearly understood that these are merely examples of how the principles of this disclosure could be utilized, and accordingly the disclosure principles are not limited in any way to the particular details of the described examples.

Furthermore, it should be understood that the system 10 depicted in FIG. 1 is illustrated and described herein merely to demonstrate one application in which the disclosure principles may be utilized. None of the details of the system 10 described herein are necessary for utilization of the disclosure principles. Instead, a wide variety of very different systems can utilize the disclosure principles.

As noted above, the seal elements 40, 56 of the packer assemblies 16, 18 may include swellable materials 52, 58. Any type of swellable material may be used for the materials 52, 58 in the packer assemblies 16, 18. The term "swell" and similar terms (such as "swellable") are used herein to indicate an increase in volume of a material. Typically, this increase in volume is due to incorporation of molecular components of the fluid into the swellable material itself, but other swelling mechanisms or techniques may be used, if desired. Note that swelling is not the same as expanding, although a material may expand as a result of swelling.

For example, in some conventional packers, a seal element may be expanded radially outward by longitudinally compressing the seal element, or by inflating the seal element. In each of these cases, the seal element is expanded without any increase in volume of the material of which the seal element is made. Thus, in these conventional packers, the seal element expands, but does not swell.

The fluid which causes swelling of the swellable materials 52, 58 could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the materials 52, 58 could be delayed until the material is positioned downhole where a predetermined elevated temperature exists.

The fluid could cause swelling of the swellable materials 52, 58 due to passage of time. The fluid which causes swelling of the materials 52, 58 could be naturally present in the well, or it could be conveyed with the packer assemblies 16, 18, conveyed separately or flowed into contact with the materials 52, 58 in the well when desired. Any manner of contacting the fluid with the materials 52, 58 may be used in keeping with the principles of the present disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable materials 52, 58 may have a substantial portion of cavities therein which are compressed or collapsed at the surface condition. Then, after being placed in the well at a higher pressure, the materials 52, 58 may be expanded by the cavities filling with fluid.

This type of apparatus and method might be used where it is desired to expand the materials 52, 58 in the presence of gas rather than oil or water. A suitable swellable material is described in U.S. Published Application No. 2007-0257405, the entire disclosure of which is incorporated herein by this reference.

Preferably, the swellable materials 52, 58 used in the packer assemblies 16, 18 swell by diffusion of hydrocarbons into the swellable material, or in the case of a water swellable material, by the water being absorbed by a super-absorbent material (such as cellulose, clay, etc.) and/or through osmotic activity with a salt like material. Hydrocarbon-, water- and/or gas-swellable materials may be combined in the seal elements 40, 56 of the packer assemblies 16, 18, if desired.

It should, thus, be clearly understood that any type or combination of swellable material which swells when contacted by any type of fluid may be used in keeping with the principles of this disclosure. Swelling of the materials 52, 58 may be initiated at any time, but preferably the material swells at least after the packer assemblies 16, 18 are installed in the well.

Swelling of the materials 52, 58 may be delayed, if desired. For example, a membrane or coating may be on any or all surfaces of the materials 52, 58 to thereby delay swelling of the material. The membrane or coating could have a slower rate of swelling, or a slower rate of diffusion of fluid through the membrane or coating, in order to delay swelling of the materials 52, 58. The membrane or coating could have reduced permeability or could break down in response to exposure to certain amounts of time and/or certain temperatures. Suitable techniques and arrangements for delaying swelling of a swellable material are described in U.S. Pat. No. 7,143,832 and in U.S. Published Application No. 2008-0011473, the entire disclosures of which are incorporated herein by this reference.

Figure 2:
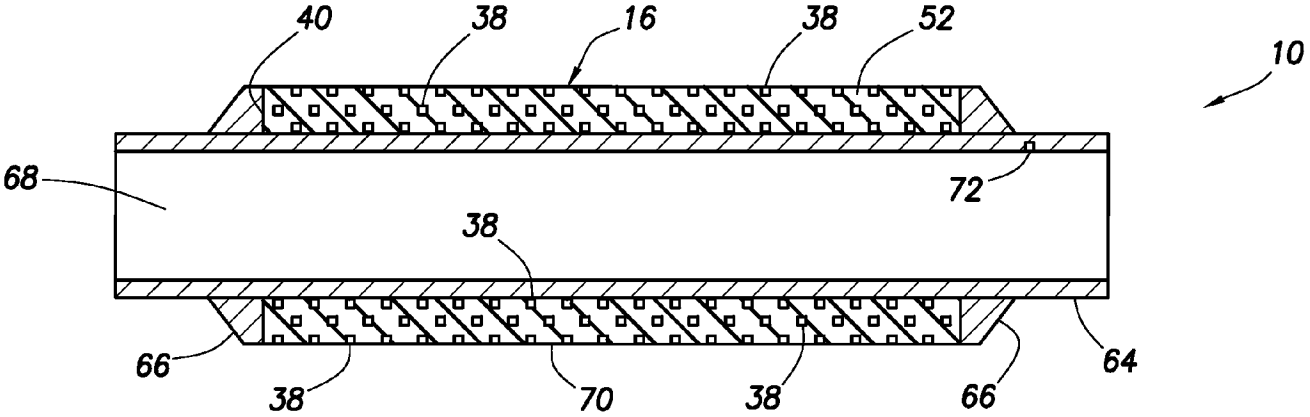
FIGS. 2 & 3 are schematic cross-sectional views of a packer assembly which may be used in the sensor system of FIG. 1, the packer assembly being in a run-in condition in FIG. 2, and the packer assembly being in a set condition in FIG. 3.
Figure 3:
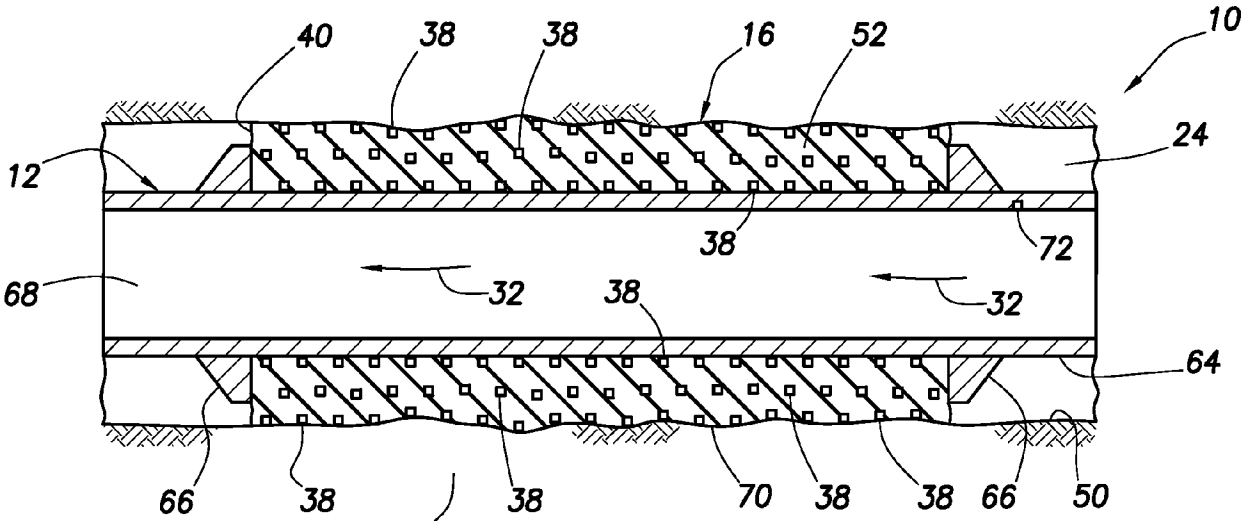

Referring additionally now to FIGS. 2 & 3, one possible configuration of the packer assembly 16 in the system 10 is representatively illustrated. The packer assembly 16 is depicted in a run-in condition in FIG. 2, apart from the remainder of the system 10, and the packer assembly is depicted in a set configuration in FIG. 3. Although only the exemplary details and features of the packer assembly 16 are described below, the packer assembly 18 may include any or all of these same details and features.

The packer assembly 16 of FIGS. 2 & 3 includes a generally tubular base pipe 64, with the seal element 40 being radially outwardly disposed on an exterior of the base pipe. A flow passage 68 extends longitudinally through the base pipe 64. End rings 66 straddle the seal element 40 to thereby secure the seal element on the base pipe 64 and enhance the differential pressure resisting capacity of the seal element.

In various embodiments, the seal element 40 could slip onto the base pipe 64, could be molded onto the base pipe, could be bonded, adhered, vulcanized or otherwise secured to the base pipe, with or without use of the end rings 66. The end rings 66 could be separately or integrally formed with the base pipe 64, and could be welded, fastened or otherwise secured to the base pipe.

The packer assembly 16 includes multiple sensors 38. The sensors 38 are depicted as being generally evenly distributed or dispersed in the seal element 40, with some of the sensors being positioned at an outer seal surface 70 of the seal element, some sensors being positioned in contact with both of the base pipe 64 and the seal element at an interface therebetween, and some of the sensors being positioned in the seal element between the seal surface and the base pipe. The sensors 38 can be positioned at any one of these positions, or at any combination of these positions, in keeping with the principles of this disclosure.

The sensors 38 can be any type or combination of sensors. Preferably, the sensors 38 comprise pressure and temperature sensors, but other types of sensors (such as resistivity, capacitance, radiation, strain, water cut, composition, density, etc. sensors) may be used, if desired. The sensors 38 can be any size, including very small (such as the nano-scale sensors described in U.S. Published Application No. 2008/0125335, the entire disclosure of which is incorporated herein by this reference).

Note that the sensors 38 positioned at the seal surface 70 will preferably contact the wellbore surface 50 when the swellable material 52 swells, as depicted in FIG. 3. These sensors 38 can, thus, directly measure pressure and temperature (and/or other properties) of the interval 34 (and/or the fluid 32 therein) at the wellbore surface 50. The other sensors 38 in the seal element 40 can directly measure pressure and temperature (and/or other properties) within the seal element.

There are many potential uses for the indications of pressure, temperature, etc. output by the sensors 38. For example, it is expected that the sensors 38 will be useful for determining properties (such as hydrostatic pressure and ambient temperature, etc.) in the wellbore 14 during and after conveyance of the packer assembly 16 into the well. However, a subsequent increase in pressure in the seal element 40 as detected by the sensors 38 can indicate that the seal element has swollen and contacted the wellbore surface 50, and is pressing against the wellbore surface. The amount of the pressure increase can indicate whether the seal element 40 has sealingly engaged the wellbore surface 50, and can indicate the differential pressure sealing capability of this sealing engagement.

The sensors 38 at the seal surface 70 in contact with the wellbore surface 50 can indicate the pressure, temperature, etc. of the interval 34 and/or the fluid 32 therein. If another sensor 72 is used to determine properties of the fluid 32 flowing though the passage 68, then certain determinations (e.g., flow rate, composition, thermal properties, physical properties, etc.) regarding the fluid can be made based on, for example, a difference in temperatures detected by the sensors 38, 72, a difference in pressures detected by the sensors, etc.

If the other packer assembly 18, or other packer assemblies 16 isolating other zones in the same well are similarly equipped with the sensors 38, 72, then the contribution of each fluid 32, 42 to the commingled flow from each zone through the tubular string 12 can be determined. That is, if the flow rate of the fluid 32 is known (e.g., based on pressure and/or temperature differences as indicated by the sensors 38, 72 of the packer assembly 16) and the flow rate of the commingled fluids 32, 42 is known (e.g., based on pressure and/or temperature differences as indicated by the sensors 38, 72 of the packer assembly 18), then the flow rate of the fluid 42 can conveniently be determined. Flow profiling, to determine both the flowrate and relative composition of oil, water and gas can also be conducted with the data obtained from sensors 38 and 72.

The sensors 38 can also be used to determine a shape and/or volume of the seal element 40, before and/or after the seal element has swollen. When the seal element 40 contacts the wellbore surface 50, the shape of the wellbore surface can be determined based on the indications provided by the sensors 38.

Detailed mapping of the wellbore surface 50 can be useful for various purposes. Over time, changes in the shape of the wellbore surface 50 as indicated by the outputs of the sensors 38 can indicate changes in wellbore stresses. This information may be useful in planning remedial operations, stimulation operations, etc.

If the sensors 38 detect water or gas encroachment, the flow control device 36 can be actuated to restrict or completely shut off flow of the fluid 32 from the interval 34 into the tubular string 12. At the time the packer assembly 16 is set, the flow control device 36 can be actuated to open and permit flow of the fluid 32 from the interval 34 into the tubular string 12, in response to the sensors 38 detecting that the packer assembly has set (e.g., that the seal element 40 sealingly engaged the wellbore surface 50). Other types of well tools (such as packers, chemical injectors, sensors, actuators, etc.) may be actuated or activated in response to the indications provided by the sensors 38, 72.

Figure 4:
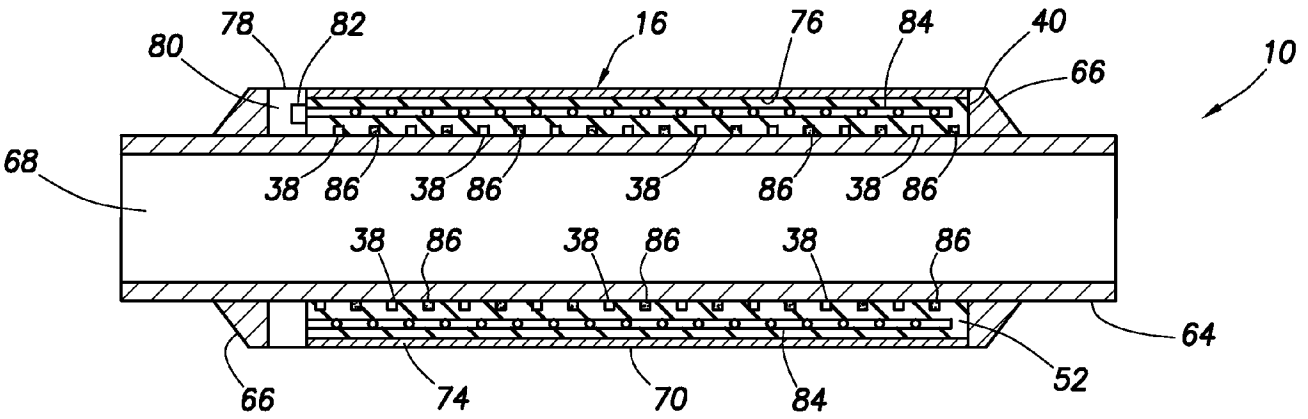
FIGS. 4 & 5 are schematic cross-sectional views of another configuration of the packer assembly, with the packer assembly being in a run-in condition in FIG. 4, and the packer assembly being in a set condition in FIG. 5.
Figure 5:
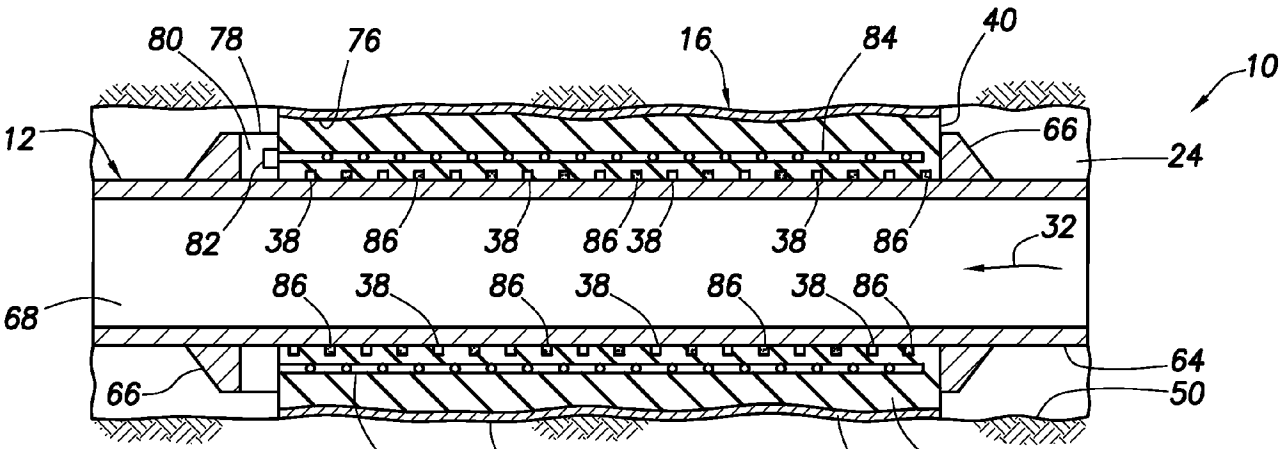

Referring additionally now to FIGS. 4 & 5, another configuration of the packer assembly 16 in the system 10 is representatively illustrated. In this configuration, the packer assembly 16 includes multiple sensors 38 which are positioned at the interface between the base pipe 64 and the seal element 40. However, the sensors 38 could be otherwise positioned (e.g., as in the configuration of FIGS. 2 & 3), if desired.

In addition, the seal element 40 includes a substance 74 which is detectable by the sensors 38. As depicted in FIGS. 4 & 5, the substance 74 is incorporated into an outer layer 76 of the seal element 40, so that the seal surface 70 is on an exterior of the layer 76, but other configurations may be used, if desired. For example, the substance 74 could be positioned in the interior of the seal element 40, the substance could be dispersed or distributed within the seal element, etc.

Preferably, the sensors 38 provide indications of the proximity of the substance 74 (e.g., the distance between the sensors and the substance). As depicted in FIG. 4, prior to setting the packer assembly 16, the sensors 38 would indicate a consistent distance between the sensors and the substance 74 along the length of the seal element 40.

However, after the packer assembly 16 has been set as depicted in FIG. 5, the sensors 38 would indicate variations in the distance between the sensors and the substance 74 along the length of the seal element 40. In this manner, the shape and volume of the seal element 40 can conveniently be determined, and the shape of the wellbore surface 50 can conveniently be determined after the seal element has contacted and conformed to the wellbore surface. Changes in the shape and volume of the seal element 40 and wellbore surface 50 over time can also be monitored using the configuration of FIGS. 4 & 5.

If it is determined that the differential pressure sealing capability of the seal element 40 is inadequate (e.g., due to a decrease in, or otherwise insufficient, pressure in the seal element as indicated by the sensors 38, due to lack of, or otherwise insufficient, contact between the seal surface 70 and the wellbore surface 50 as indicated by the sensors, etc.), it may be desired to induce further swelling of the seal element. For this purpose, the packer assembly 16 includes a reservoir 78 containing a swell-inducing fluid 80. The fluid 80 may also, or instead, be used to initiate swelling of the swellable material 52 to initially set the packer assembly 16 as described above.

When it is desired to induce swelling (or further swelling) of the swellable material 52, a flow control device 82 is actuated to flow the fluid 80 into contact with the swellable material via perforated tubes 84 extending longitudinally into the seal element 40. The flow control device 82 may include a pump, piston, biasing device, etc. for forcing the fluid 80 to flow from the reservoir 80 into the seal element 40. Preferably, the flow control device 82 is operable in response to the indications provided by the sensors 38.

The packer assembly 16 further includes electrical devices 86 which operate in conjunction with the sensors 38. For example, the devices 86 could be electrical generators which generate electricity to provide power for the sensors 38. In that case, the devices 86 could generate electrical power in response to swelling of the swellable material 52 (e.g., the devices could include piezoelectric or magnetostrictive material, etc.). The amount of electrical power generated by the devices 86 and the location and number of devices generating such power could be detected by the sensors 38 as an indication of the packer assembly 16 setting, the extent of swelling of the swellable material 52, the shape and/or volume of the seal element 40 and/or the shape of the wellbore surface 50, etc.

Alternatively, or in addition, the devices 86 could be switches, activation of which is detected by the sensors 38, or which operate to supply power to the sensors. In that case, the devices 86 could be very small scale polymer switches dispersed or distributed in the seal element 40 and operative in response to a predetermined pressure at each switch in the seal element. The number and location of activated switches could be detected by the sensors 38 as an indication of the packer assembly 16 setting, the extent of swelling of the swellable material 52, the shape and/or volume of the seal element 40 and/or the shape of the wellbore surface 50, etc.

Figure 6:
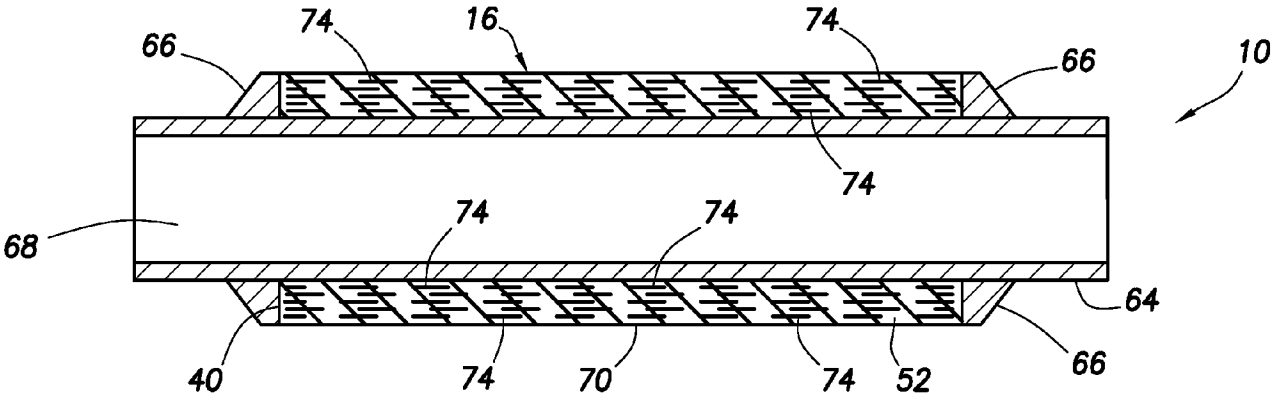
FIGS. 6 & 7 are schematic cross-sectional views of another configuration of the packer assembly, with the packer assembly being in a run-in condition in FIG. 6, and the packer assembly being in a set condition in FIG. 7.
Figure 7:
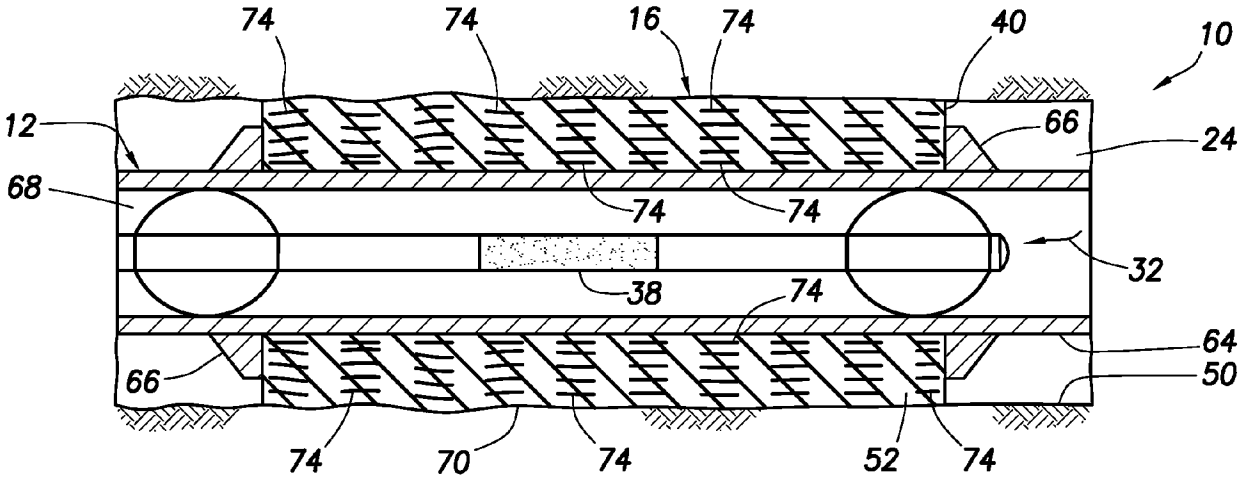

Referring additionally now to FIGS. 6 & 7, another configuration of the packer assembly 16 in the system 10 is representatively illustrated. In this configuration, the substance 74 is distributed fairly evenly in the seal element 40, and the sensor 38 used to detect the substance is conveyed separately into the passage 68 (e.g., via wireline, slickline, coiled tubing, etc.).

The sensor 38 detects the presence, location, proximity, density (e.g., mass of the substance 74 per unit volume of the seal element 40) and/or other parameters related to the substance. For example, it will be appreciated that the density of the substance 74 in the seal element 40 decreases as the seal element swells. If the sensor 38 detects the density of the substance 74, then the amount of swelling of the seal element 40 at various locations along its length can be conveniently determined, as well as the shape and volume of the seal element, and the shape of the wellbore surface 50 after the seal element has contacted and conformed to the wellbore surface.

Conversely, it will be appreciated that spacing between the multiple substances 74 in the seal element 40 increases as the seal element swells. If the sensor 38 detects the spacing of the substances 74, then the amount of swelling of the seal element 40 at various locations along its length can be conveniently determined, as well as the shape and volume of the seal element, and the shape of the wellbore surface 50 after the seal element has contacted and conformed to the wellbore surface.

FIGS. 4-7 depict just a few examples of how the substance 74 may be used in conjunction with the sensor 38 to determine various characteristics of the seal element 40 and wellbore surface 50. Other ways of detecting and monitoring these and other characteristics of the seal element 40 and/or wellbore surface 50 may be used in keeping with the principles of this disclosure.

The substance 74 could be any type of substance which may be detectable by one or more sensors 38. For example, the substance 74 could be an ion implant, a metal (such as metal particles or a metal layer, etc.), a radioactive material, small radio frequency (RF) transmitters (which could be supplied with electrical power and/or activated using the electrical devices 86 described above), etc.

Energy output by the substance 74 (e.g., electromagnetic energy from RF transmitters) may vary in response to swelling of the swellable material 52. The sensor 38 may be operative to detect the energy output.

Figure 8:
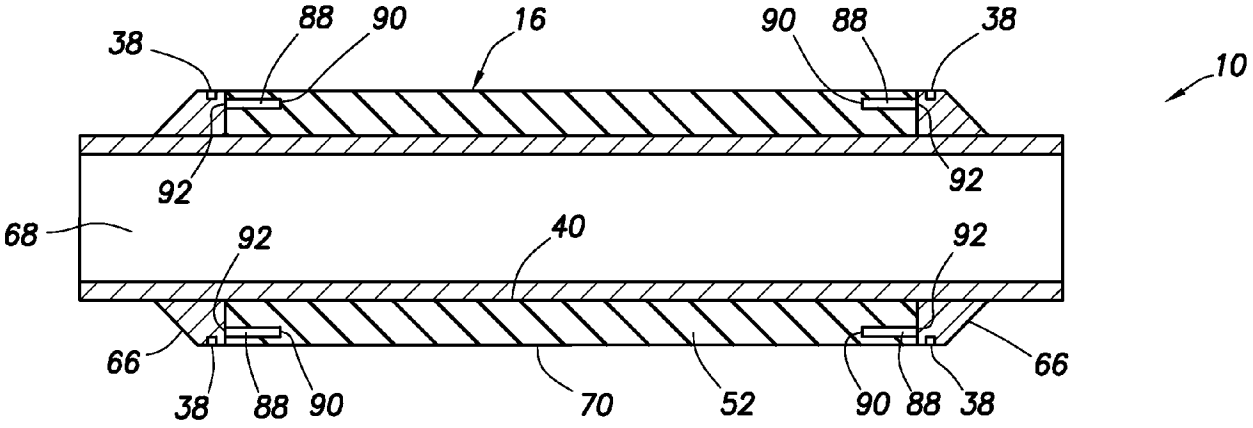
FIGS. 8 & 9 are schematic cross-sectional views of another configuration of the packer assembly, with the packer assembly being in a run-in condition in FIG. 8, and the packer assembly being in a set condition in FIG. 9.
Figure 9:
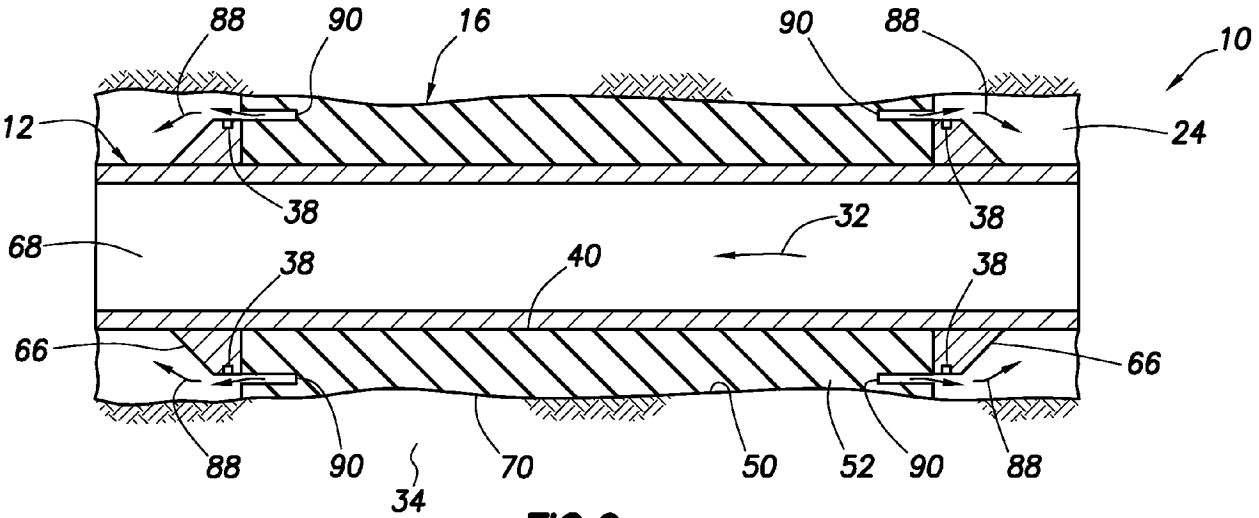

Referring additionally now to FIGS. 8 & 9, another configuration of the packer assembly 16 as used in the system 10 is representatively illustrated. In this configuration, multiple sensors 38 are incorporated into, or otherwise positioned at, the end rings 66. The sensors 38 are used to detect setting of the packer assembly 16 (e.g., by detecting swelling of the swellable material 52).

A tracer material 88 is contained in a release device 90 positioned in the seal element 40. When the seal element 40 swells and the release device 90 is thereby exposed to a sufficient predetermined pressure increase, a barrier 92 (such as a rupture disc, etc.) at an outer end of the release device will burst, releasing the material 88 proximate the sensor 38.

For example, the predetermined pressure increase could be due to the seal element 40 contacting and pressing against the wellbore surface 50 with enough force to produce a desired level of sealing engagement. If the sensors 38 do not detect the tracer material 88, then this is an indication that the desired sealing engagement has not been obtained.

In another embodiment, the tracer material could be encapsulated into the swellable material on or near the surface of the packer which is expected to come into contact with the wellbore surface, near the middle of the element 16. When the swellable material swells, the tracer material would be released due to the expansion or bursting of the encapsulation material surrounding the tracer material. Fluid flowing by the swellable material would flow the tracer material by the sensor 38, or to the surface where the tracer material could be detected. Thus, one would be able to determine that the swellable material was swelled to a certain degree (e.g., the amount needed to burst the encapsulation material). Once the swellpacker swelled sufficiently to seal against the borehole surface, the tracer material would no longer be released, as it would be trapped between the borehole surface and the swellable material. Thus, by first detecting that the tracer material was present, either at the sensor 38 or at the surface, then was absent, say after the predicted time for the swellpacker to set, one could confirm that the swellable packer began to set and completed setting.

If the sensors 38 do detect the tracer material 88, then this is an indication that the desired sealing engagement has been obtained, and the packer assembly 16 is fully set. Although multiple sensors 38 and release devices 90 are depicted in FIGS. 8 & 9, only one of each could be used, if desired.

The tracer material 88 may be any type of fluid or other material which is detectable by the sensor 38. For example, the material 88 could be brine water or another highly conductive fluid which could be conveniently detected by a conductivity or resistivity sensor 38. The material 88 could be a relatively dense or light weight fluid which could be detected by a density sensor 38. The material 88 could be radioactive and detectable by a radioactivity sensor 38. Many other types of material 88 and sensor 38 combinations are possible in keeping with the principles of this disclosure.

Figure 10:
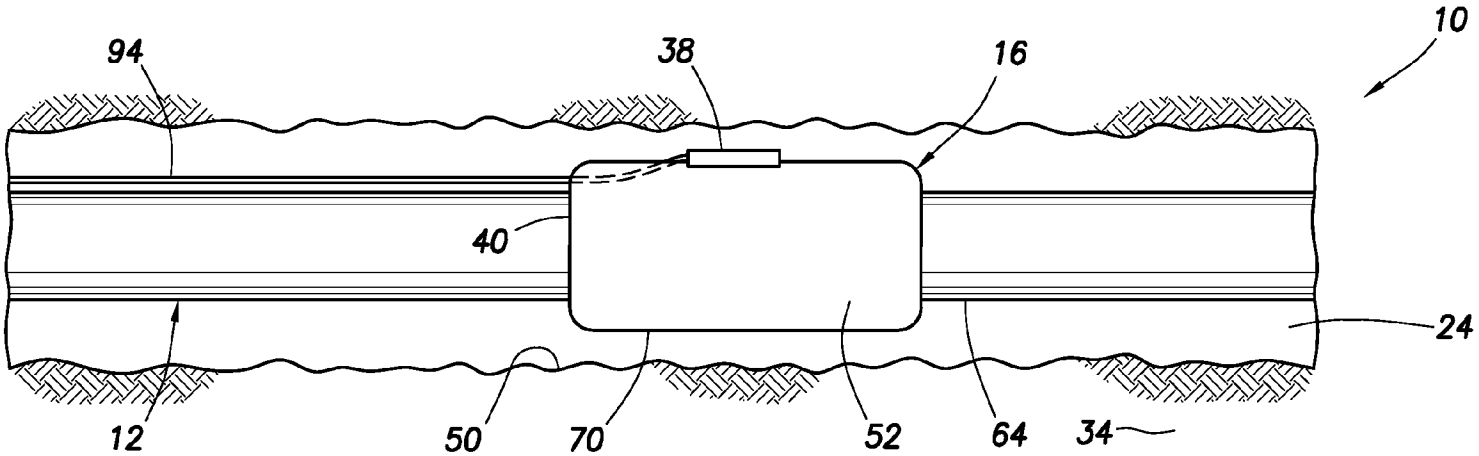
FIGS. 10 & 11 are schematic cross-sectional views of another configuration of the packer assembly, with the packer assembly being in a run-in condition in FIG. 10, and the packer assembly being in a set condition in FIG. 11.
Figure 11:
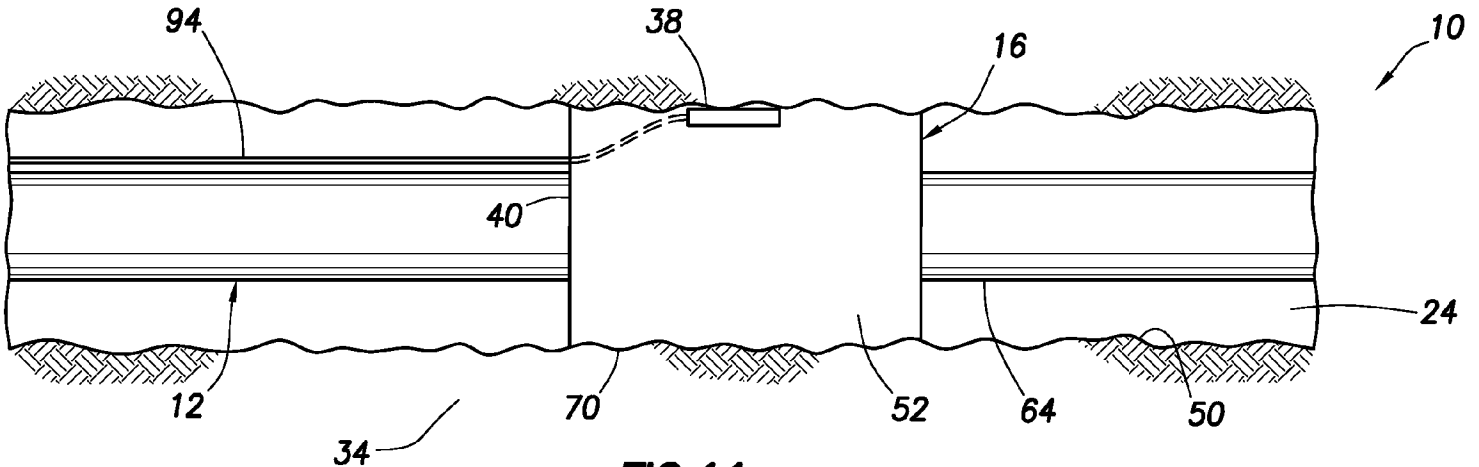

Referring additionally now to FIGS. 10 & 11, another configuration of the packer assembly 16 as used in the system 10 is representatively illustrated. In this configuration, the sensor 38 is carried externally on the seal element 40 and is pressed against the wellbore surface 50 when the swellable material 52 swells to set the packer assembly 16. A line 94 is depicted in FIGS. 10 & 11 for transmitting indications from the sensor 38 to a remote location, but various forms of telemetry may be used for this purpose in keeping with the principles of this disclosure.

The sensor 38 could be clamped, bonded with adhesive or fastened in any other way to the seal element 40. The line 94 could be clamped to the base pipe 64 and tubular string 12, and could be extended through the seal element 40 to the sensor 38 via a slit or conduit formed in the seal element.

Figure 12:
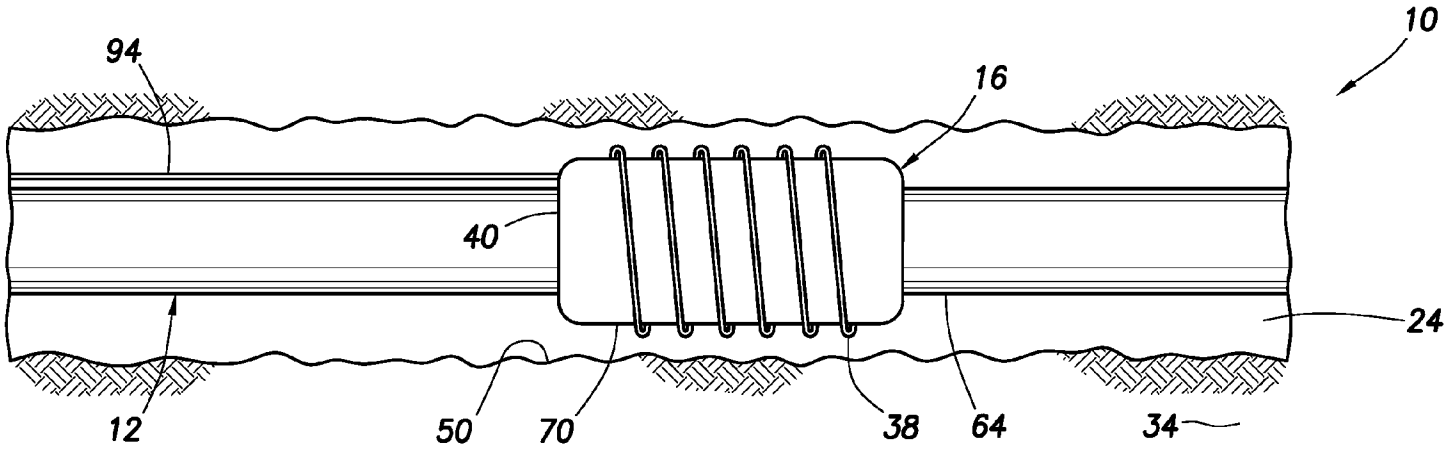
FIGS. 12 & 13 are schematic cross-sectional views of another configuration of the packer assembly, with the packer assembly being in a run-in condition in FIG. 12, and the packer assembly being in a set condition in FIG. 13.
Figure 13:
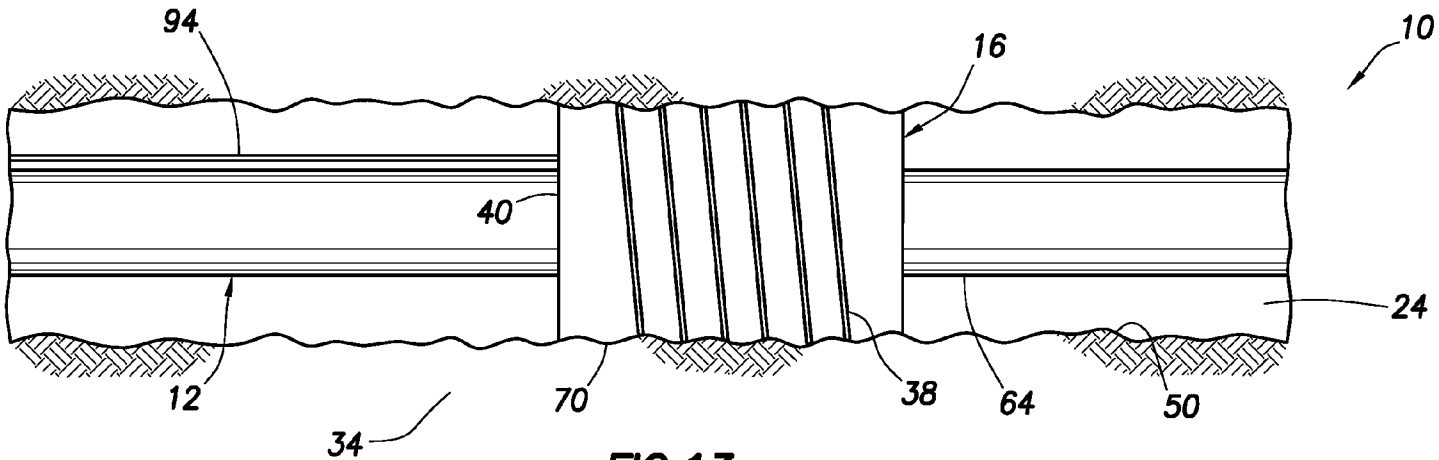

Referring additionally now to FIGS. 12 & 13, another configuration of the packer assembly 16 as used in the system 10 is representatively illustrated. In this configuration, the sensor 38 is in the form of an optical waveguide (such as an optical fiber, etc.) which is wrapped helically about the exterior of the seal element 40.

In the set condition of the packer assembly 16, the sensor 38 is pressed against the wellbore surface 50 by the seal element 40. Thus, the sensor 38 can directly detect parameters related to the wellbore surface 50 and interval 34. The sensor 38 can also detect parameters related to the seal element 40 (such as strain, volume change, pressure and/or temperature in the seal element, etc.).

The sensor 38 could be a distributed temperature sensor (e.g., utilizing the principle of Raman backscattering of light to detect temperature along the length of the optical waveguide) and/or the sensor could be an optical pressure sensor (e.g., utilizing Bragg gratings) and/or the sensor could be an optical strain sensor (e.g., utilizing interferometric strain sensing techniques) and/or any other type of sensor.

Figure 15:
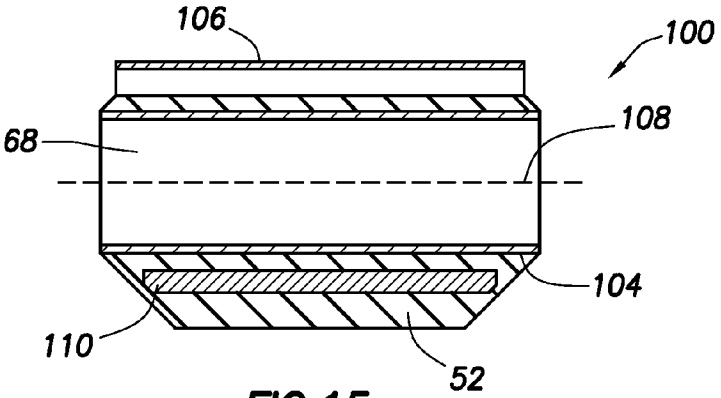
FIGS. 14-16 are schematic end and cross-sectional views of a swellable well tool system, with the system being in a run-in condition in FIGS. 14 & 15, and the system being in a set condition in FIG. 16.
Figure 14:
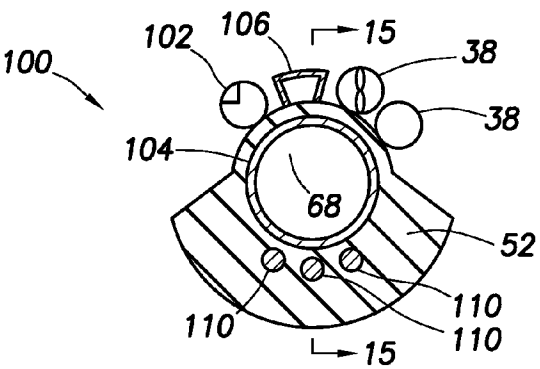
Figure 16:
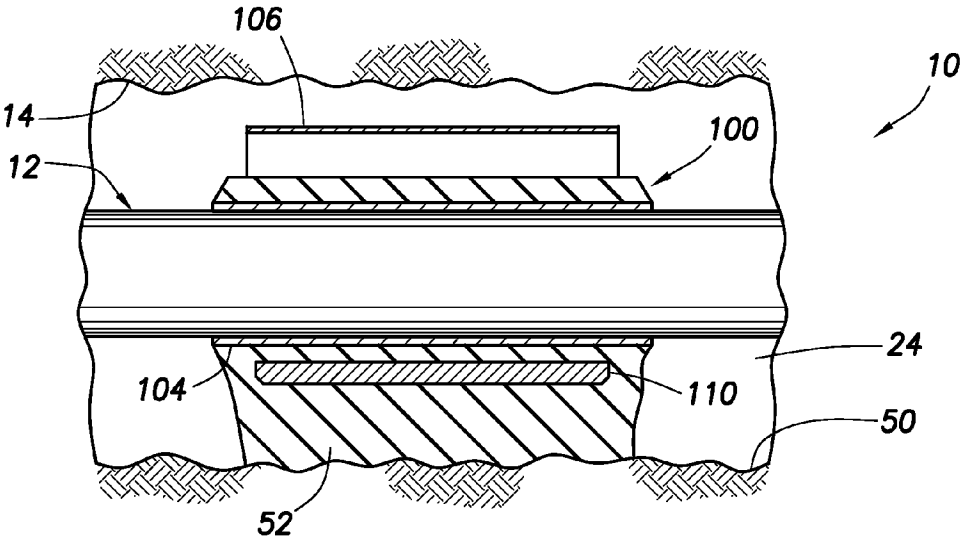

Referring additionally now to FIGS. 14-16, a swellable well tool system 100 as used in the system 10 is representatively illustrated. The swellable well tool system 100 may be used where it is desired to utilize the swellable material 52 to laterally displace sensors 38 and/or other components (such as a perforator 102, shunt tube 106, etc.) relative to the wellbore 14. For example, it may be desired to azimuthally orient the components 38, 102, 106 toward an upper side of the wellbore 14 if the wellbore is non-vertical (i.e., horizontal or deviated).

In this configuration, the swellable material 52 is not used to seal off the annulus 24, but is instead used to displace the components 38, 102, 106 in a desired direction relative to the wellbore 14. However, the swellable material 52 could be used to seal off the annulus 24 in the configuration of FIGS. 14-16, if desired.

It will be appreciated that the swellable material 52 is eccentrically weighted with respect to a longitudinal axis 108 of a base pipe 104. The base pipe 104 could be interconnected (e.g., by threading, etc.) in the tubular string 12 directly, or the base pipe may be slipped over the tubular string and secured thereto as depicted in FIG. 16. In either case, the longitudinal axis 108 of the base pipe 104 will preferably correspond to a longitudinal axis of the tubular string 12.

The eccentric weighting is accomplished in the swellable well tool system 100 using various techniques. Firstly, a greater mass of the swellable material 52 is positioned on one side of the axis 108. Secondly, weights 110 are positioned in the swellable material 52 on one side of the axis 108. Thirdly, an overall weight on one side of the axis 108 is greater than an overall weight on an opposite side of the axis.

When conveyed into the wellbore 14, the greater overall weight will be induced by the force of gravity to displace to the lower side of the wellbore. As long as the eccentric weighting is not directly above or below the axis 108, rotation of the system 100 about the axis 108 will be caused by the force of gravity. In the example of FIGS. 14-16, this results in the components 38, 102, 106 being azimuthally oriented toward the upper side of the wellbore 14 and, since the swellable material 52 is in contact with the wellbore surface 50, swelling of the swellable material will displace the components further upward in the wellbore as shown in FIG. 16.

Of course, the swellable well tool system 10 could be differently configured to otherwise displace components in the wellbore 14. For example, the swellable material 52 could contact the wellbore surface 50 at an upper side of the wellbore 14, opposite the axis 108 from a greater overall eccentric weighting (e.g., opposite the weights 110), to thereby displace the components downward in the wellbore.

In the above disclosure, the various examples of the packer assembly 16 have been specifically described, but the packer assembly 18 is only depicted in FIG. 1. Nevertheless, it should be understood that the packer assembly 18 can include any, all, or any combination of the features described above for the packer assembly 16 in its various examples.

It may now be fully appreciated that the above disclosure provides many advancements to the art of activating and monitoring swellable materials in a subterranean well. In particular, sensors 38, 72 can be used to detect setting of the packer assemblies 16, 18, shape and volume of the seal element 40, swelling of the swellable materials 52, 58, shape of the wellbore surface 50, pressure, temperature and other characteristics of the intervals 34, 44, pressure, temperature and other characteristics of the fluids 32, 42, stresses proximate the wellbore 14, changes in these parameters, etc.

The above disclosure describes a sensor system 10 for use in a subterranean well, with the system 10 including a swellable material 52, and at least one sensor 38 which detects swelling of the swellable material 52.

The system 10 may also include a release device 90 which releases a tracer material 88 in response to swelling of the swellable material 52. The sensor 38 may be operative to detect release of the tracer material 88. The release device 90 may include a barrier 92 which ruptures in response to an increase in pressure in the release device 90 due to swelling of the swellable material 52.

The swellable material 52, sensor 38 and tracer material 88 may be incorporated into a packer assembly 16 which is operative to seal off an annulus 24 in the well. The packer assembly 16 may also include end rings 66 which straddle the swellable material 52. The sensor 38 may be secured to at least one of the end rings 66.

The system 10 may include a well tool 20 which actuates in response to detection by the sensor 38 of swelling of the swellable material 52. The well tool 20 may include a flow control device 36.

The sensor 38 may detect at least one substance 74 in the swellable material 52. The substance 74 may displace as the swellable material 52 swells. The sensor 38 may detect the displacement of the substance 74.

A spacing between multiple substances 74 may vary in response to swelling of the swellable material 52. The sensor 38 may detect the substance 74 spacing.

A density of the substance 74 in the swellable material 52 may vary in response to swelling of the swellable material 52. The sensor 38 may detect the substance 74 density.

Energy output by the substance 74 may vary in response to swelling of the swellable material 52. The sensor 38 may detect the energy output.

The swellable material 52 may be on an exterior of a base pipe 64. The sensor 38 may be conveyed through an interior of the base pipe 64.

The substance 74 may comprise an ion implant.

The swellable material 52 with the substance 74 therein may conform to a wellbore surface 50 in response to swelling of the swellable material 52. The sensor 38 may detect a shape of the wellbore surface 50 as represented by a shape of the substance 74.

The substance 74 may be distributed in a volume of the swellable material 52. A shape of the volume may change in response to swelling of the swellable material 52. The sensor 38 may detect the volume shape.

Different substances 74, or different detectable trace elements or compositions in substance 74 could be employed in different swellable packers in the same wellbore. Thus, one could identify which swellable packer the substance 74 is being released from, thus determining, for example, which specific packer might not be setting properly.

The system 10 may include a switch 86 which activates in response to swelling of the swellable material 52. The switch 86 may be connected to the sensor 38. The sensor 38 may operate in response to activation of the switch 86.

The system 10 may include an electrical generator 86 which generates electricity in response to swelling of the swellable material 52. The generator 86 may be connected to the sensor 38. The sensor 38 may operate using electricity supplied by the generator 86.

The sensor 38 may comprise an optical waveguide which encircles the swellable material 52.

The swellable material 52 may be on an exterior of a base pipe 64. The sensor 38 may be in contact with the swellable material 52 and the base pipe 64.

The swellable material 52 and the sensor 38 may be positioned in a non-vertical wellbore 14. The swellable material 52 may displace the sensor 38 toward an upper side of the wellbore 14 in response to swelling of the swellable material 52.

Also provided by the above disclosure is a swellable well tool system 100 which includes a base pipe 104, a swellable material 52 on an exterior of the base pipe 104, and eccentric weighting (e.g., an eccentric mass of the swellable material 52, the weights 110, etc.) for inducing rotation of the swellable material 52 about a longitudinal axis 108 of the base pipe 104.

The eccentric weighting may induce rotation of the swellable material 52 about the longitudinal axis 108 when the longitudinal axis 108 is non-vertical and the eccentric weighting is not directly vertically above or below the longitudinal axis 108.

The swellable material 52 and a sensor 38 may be positioned in a non-vertical wellbore 14. The swellable material 52 may displace the sensor 38 toward an upper side of the wellbore 14 in response to swelling of the swellable material 52.

The eccentric weighting may comprise at least one weight 110 positioned at least partially within the swellable material 52.

The system 100 may include at least one sensor 38 positioned opposite the base pipe 104 from the eccentric weighting. The swellable material 52 may displace the sensor 38 toward an upper side of a wellbore 14 in response to swelling of the swellable material 52.

The system 100 may include at least one tube 106 positioned opposite the base pipe 104 from the eccentric weighting. The swellable material 52 may displace the tube 106 toward an upper side of a wellbore 14 in response to swelling of the swellable material 52.

The system 100 may include at least one perforator 102 positioned opposite the base pipe 104 from the eccentric weighting. The swellable material 52 may displace the perforator 102 toward an upper side of a wellbore 14 in response to swelling of the swellable material 52.

The above disclosure also describes a sensor system 100 for use in a subterranean well, with the system 10 including a first swellable material 52, and at least one first sensor 38 which is displaced to a first wellbore surface 50 in response to swelling of the first swellable material 52.

The system 10 may also include a second sensor 72. The first swellable material 52 may be on an exterior of a first base pipe 64. The first wellbore surface 50 may be formed on a first interval 34 intersected by the well. The second sensor 72 may detect a property of a first fluid 32 which flows between the first interval 34 and an interior of the first base pipe 64.

The first and second sensors 38, 72 may comprise temperature sensors. A difference in temperature detected by the first and second sensors 38, 72 may indicate at least one of a flow rate, composition and a thermal property of the first fluid 32.

The first and second sensors 38, 72 may comprise pressure sensors. A difference in pressure detected by the first and second sensors 38, 72 may indicate at least one of a flow rate, composition and a physical property of the first fluid 32.

The system 10 may include a second swellable material 58 on an exterior of a second base pipe (such as the base pipe 64). At least one third sensor 38 may be displaced to a second wellbore surface 54 in response to swelling of the second swellable material 58. The second wellbore surface 54 may be positioned in a second interval 44 intersected by the well. A fourth sensor (such as sensor 72) may detect a property of the first fluid 32 and a second fluid 42 which flows between the second interval 44 and an interior of the second base pipe.

The first, second, third and fourth sensors 38, 72 may comprise temperature sensors. The first and second sensors 38, 72 may provide an indication of contribution to flow though the second base pipe by the first fluid 32. The third and fourth sensors 38, 72 may provide an indication of contribution to flow through the second base pipe by the second fluid 42.

The first sensor 38 may comprise an optical waveguide. The optical waveguide may encircle the first swellable material 52.

The first sensor 38 may detect swelling of the first swellable material 52. The system 10 may include a well tool 20 which actuates in response to detection by the first sensor 38 of swelling of the first swellable material 52. The well tool 20 may comprise a flow control device 36.

The first sensor 38 may detect a shape of the first wellbore surface 50. A shape of a volume of the swellable material 52 may change in response to swelling of the swellable material 52. The first sensor 38 may detect the volume shape.

The system 10 may include a switch 86 which activates in response to swelling of the first swellable material 52. The switch 86 may be connected to the first sensor 38. The first sensor 38 may operate in response to activation of the switch 86.

The system 10 may include an electrical generator 86 which generates electricity in response to swelling of the first swellable material 52. The generator 86 may be connected to the first sensor 38. The first sensor 38 may operate using electricity supplied by the generator 86.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A sensor system for use in a subterranean well, the system comprising:

a substance distributed in and surrounded by a volume of a swellable material; and at least one sensor which detects the substance, whereby the sensor detects swelling of the swellable material.

2. The system of claim 1, wherein the substance displaces as the swellable material swells, and wherein the sensor detects displacement of the substance.

3. The system of claim 1, wherein a spacing between multiple substances varies in response to swelling of the swellable material, and wherein the sensor detects the substance spacing.

4. The system of claim 1, wherein a density of the substance in the swellable material varies in response to swelling of the swellable material, and wherein the sensor detects the substance density.

5. The system of claim 1, wherein energy output by the substance varies in response to swelling of the swellable material, and wherein the sensor detects the energy output.

6. The system of claim 1, wherein the swellable material is on an exterior of a base pipe, and wherein the sensor is conveyed through an interior of the base pipe.

7. The system of claim 1, wherein the substance comprises an ion implant.

8. The system of claim 1, wherein a shape of the volume changes in response to swelling of the swellable material, and wherein the sensor detects the volume shape.

9. A sensor system for use in a subterranean well, the system comprising:

a swellable material; and at least one sensor which detects swelling of the swellable material, wherein the sensor detects at least one substance in the swellable material, wherein the swellable material with the substance therein conforms to a wellbore surface in response to swelling of the swellable material, and wherein the sensor detects a shape of the wellbore surface as represented by a shape of the substance.

10. A sensor system for use in a subterranean well, the system comprising:

a swellable material;

at least one sensor which detects swelling of the swellable material, wherein the at least one sensor is disposed within and surrounded by a volume of the swellable material; and a switch which activates in response to swelling of the swellable material.

11. The system of claim 10, wherein the switch is connected to the sensor, and wherein the sensor operates in response to activation of the switch.

12. A sensor system for use in a subterranean well, the system comprising:

a swellable material;

at least one sensor which detects swelling of the swellable material, wherein the at least one sensor is disposed within and surrounded by a volume of the swellable material; and an electrical generator which generates electricity in response to swelling of the swellable material.

13. The system of claim 12, wherein the generator is connected to the sensor, and wherein the sensor operates using electricity supplied by the generator.

* * * * *